United States Patent [19]

Brauch et al.

[11] 4,181,087

[45] Jan. 1, 1980

[54] METHOD FOR INITIALLY POSITIONING A TRAVELING BUTTONHOLE PRESSER FOOT

[75] Inventors: Robert B. Brauch, Wayne; Russell Pepe, Piscataway, both of N.J.

[73] Assignee: The Singer Company, New York, N.Y.

[21] Appl. No.: 933,013

[22] Filed: Aug. 11, 1978

[51] Int. Cl.[2] ..... D05B 3/06

[52] U.S. Cl. ..... 112/264.1

[58] Field of Search ..... 112/264, 77, 76, 70, 112/73, 158 B, 235, 264.1, 65

[56] References Cited

U.S. PATENT DOCUMENTS

| | | | |
|---|---|---|---|
| 3,877,403 | 4/1975 | Ketterer | 112/77 |
| 4,091,752 | 5/1978 | Oderman | 112/77 X |
| 4,096,811 | 6/1978 | Marsh | 112/77 |
| 4,109,591 | 8/1978 | Rakacs | 112/77 X |

FOREIGN PATENT DOCUMENTS 359351 10/1952 Switzerland .

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A method for insuring that a traveling buttonhole presser foot, which is normally spring biased to an initial start position prior to movement of the traveling part thereof during the formation of a buttonhole, is located in the initial start position. As an initial step prior to the formation of the buttonhole, the sewing machine is operated for at least one stitch with the reversible feed regulating system thereof arranged to feed the work material in a direction to relax the biasing spring.

3 Claims, 6 Drawing Figures

Fig.3
PRIOR ART
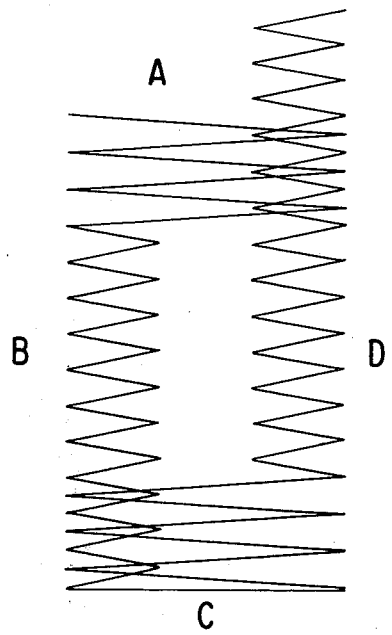
Fig.4
| STITCH | BIGHT | FEED |
|---|---|---|
| 1 | SEE (a) | -.089 |
| 2 | SEE (a) | -.089 |
| 3 | 0.0 | 0.0 |
| 4 | 0.120 | 0.0 |
| 5 | -0.120 | 0.017 |
| 6 | 0.120 | 0.0 |
| 7 | -0.120 | -0.017 |
| 8 | 0.120 | 0.0 |
| 9 | -0.120 | 0.017 |
| 10 | 0.120 | 0.0 |
a) SKIP STITCH OR STITCH IN CENTER OF EITHER BUTTONHOLE LEG.
Fig.5
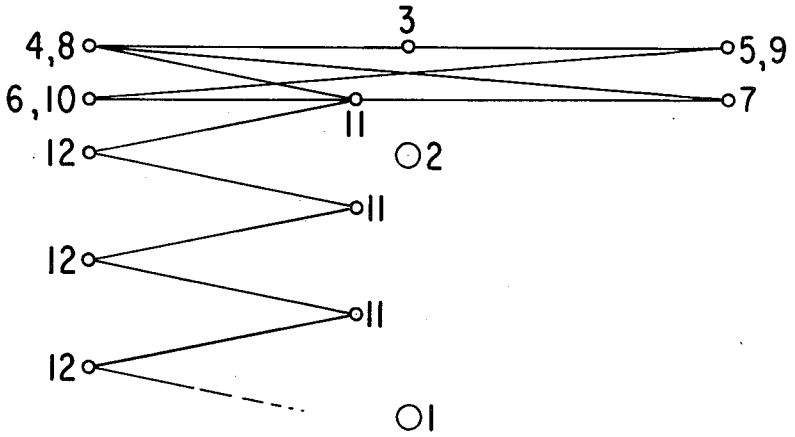

METHOD FOR INITIALLY POSITIONING A TRAVELING BUTTONHOLE PRESSER FOOT

BACKGROUND OF THE INVENTION

This invention is in the field of sewing machines, more particularly, it is concerned with a method to be used with a traveling presser foot to insure that the foot is always is in the start position upon the initiation of a buttonhole.

Heretofore, in the preparation of a buttonhole utilizing a traveling buttonhole presser foot, the operator positioned the work material beneath the presser foot in the proper location, lowered the presser foot and initiated the stitching of the buttonhole. It frequently occurred that when the buttonhole presser foot was lowered, the work material was found to be in the wrong location. In this event, there was a tendency to shift the work material into the proper position by tugging thereupon. A frequent result is that the traveling presser foot is shifted from the position from which the buttonhole should be initiated to a position space therefrom. Thereby, it frequently occurs that a buttonhole is accomplished wherein one leg is shorter than the other, and the buttonhole is not closed properly. Thus, any event which shifts the traveling presser foot from its initial position prior to the initiation of a buttonhole, will cause the manufacture of a faulty buttonhole.

What is required is some means to insure that the traveling buttonhole presser foot is always located in the starting position prior to the initiation of a buttonhole.

SUMMARY OF THE INVENTION

The above requirement is achieved in the method where prior to initiation of the buttonhole stitching the sewing machine is operated, ideally in the straight stitch mode, in a direction to urge the traveling presser foot thereof against its initital stop position. In the event that the traveling presser foot is already at its initial stop position implementation of this method will result in fabric stall without causing any motion of the traveling presser foot. However, where the traveling presser foot has been mispositioned away from its initial stop, the initial one or two stitches in a direction towards that stop will, once again, move the traveling presser foot into its initial position, and thereby avoid the manufacture of an improper buttonhole.

BRIEF DESCRIPTION OF THE DRAWINGS

Having in mind the above requirements, the invention is hereinafter set forth in such details as to enable those skilled in the art readily to understand the function, operation, construction and advantages of it, when read in conjunction with the accompanying drawings in which:

FIG. 3 is a diagram of a prior art buttonhole indicating the defects sought to be avoided by the invention; and, FIG. 4 is a table of stitch coordinates, for an electronically controlled sewing machine, of the first 10 stitches of a buttonhole;

FIG. 5 is a representation of the first bar tack and side stitches of a buttonhole implemented using the method of this invention, and indicating how the defect present in FIG. 4 may be avoided.

Referring to the drawings, 11 indicates the work supporting bed of the sewing machine which carries a throat plate 12 and a slide cover plate 13 on which work fabrics are also adapted to be supported. The throat plate 12 is formed with a needle aperture 14 and with feed dog slots 15 through which the limbs of a preferably urethane coated feed dog 16 projects upwardly (see FIG. 1*a*). In FIG. 1 a fragment of the sewing machine head 20 is shown in which a needle bar 21 is endwise reciprocal with capacity for lateral jogging movement. A thread carrying needle 22 clamped to the needle bar 21 traverses the needle aperture 14 in the throat plate in the formation of stitches defining the buttonhole.

Figure 2:
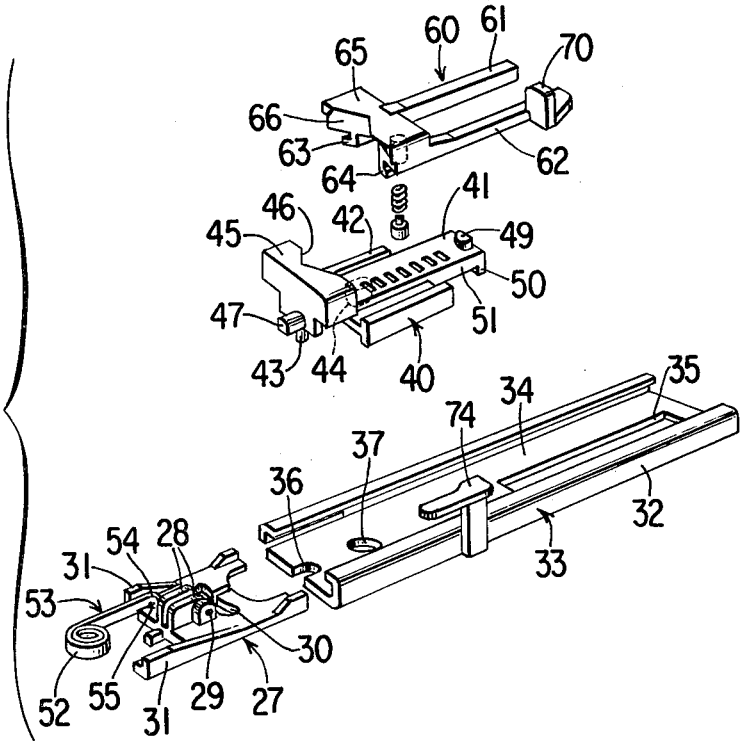
FIG. 2 is a disassembled perspective view of the presser device of FIG. 1.

Also carried in a bushing 23 in the sewing head is a presser bar 24 to which a presser foot shank 25 is clamped by a thumb screw 26. A presser foot 27 formed with cheek pieces 28 and a pivot pin 29 may be exchangely secured to the shank 25. The presser foot 27 as best shown in FIG. 2 is provided with a needle accommodating aperture 30 and is formed at each side with upstanding guide projections 31 which fit into inturned guide channels 32 formed at each side of a traveling work engaging shoe 33. The work engaging shoe 33 includes a flat sole portion 34 which underlies the presser foot 27 and overlies the feed dog limbs 16. The sole portion 34 is formed with a central elongated aperture 35 to provide clearance for needle reciprocation during buttonhole stitching. The sole portion 34 is also formed with a notch 36 at one end with a small aperture 37 adjacent to the notch for the purpose of locating thereon a button gauging device which will be described herein below.

The presser foot 27 is slidably arranged within the guide channel 32 of the working engaging shoe 33 and can move therein over the range in which the needle hole 30 in the presser foot overlies the needle hole 35 in the shoe 33. An anchor element 40 of the button gauging device is formed with the base 41 having guide projection 42 at each side adapted to fit between the guide channel 32 of the working engaging shoe 33. Depending from the base 41 are two projections 43 and 44 adapted to enter into the notch 36 and small aperture 37, respectively, of the shoe 33 to lock the anchor element firmly in place at one end of the shoe. The anchor element 40 also includes an upperwardly extending abutment 45 formed with a "V" notch 46 adapted to engage and center one side of a round button. A horizontal peg 47 projects from the abutment 45 on the side opposite the "V" notch 46. An upstanding post 49 is formed at the free extremity of the base portion 41 remote from the "V" notch 46.

The under surface of the anchor element base 41 beneath the post 49 is formed with a depending flange 50 defining a shallow cavity 51 loosely accommodating the convoluted extremity 52 of a coil flat spring 53 of which the other extremity is formed into a hook 54 engaged in a seat 55 formed in the presser foot 27. The anchor element 40 is adapted to be locked in place at one extremity of the work engaging shoe 33. Preferably, the assembly being accomplished by slight deformation of the anchor element 40 until the projections 43 and 44 enter and lock into the notch 36 and the aperture 37 respectively.

A button gauging element 60 is constrained in the guide channel 32 of the work engaging shoe 33 over the anchor element 40 and the presser foot 27. To this end, the button gaging element 60 is formed with spaced guide rails 61 and 62 each shaped to overlie one of the guide channel 32 of the work engaging shoe and each also being formed with an inturned lip 63 and 64, respectively, adapted to engage slidably in guide channel 32 and inside of both guide projections 31 on the presser foot 27 and guide projection 42 on the anchor element. The button gauging element 60 may be shifted away from the anchor element 40 to the extent permitted by the post 49 engaging an abutment element 65.

The button gauging element 60 includes an upstanding abutment element 65 formed with "V" notch 66 complemental to the "V" notch 46 in the anchor element 40 in centering and locating a button therebetween.

Projecting laterally from the guide rail 62 of the button gauging element 60 is a actuating tab 70. The position of the actuating tab 70 may be varied in accordance with the size of the button inserted between the "V" notches 66 and 46. In any event the actuating tab 70 is spaced from an actuating tab 74 permanently affixed to the traveling work engaging shoe 33. A paddle 76 may be positioned downwardly to extend between the actuating tabs 70, 74 in order to signal completion of the ends of the proper length of buttonhole side stitching to accommodate a round button which is placed between the "V" notches 66 and 46. The paddle 76 may be connected in the sewing machine to mechanical linkages for a cam controlled sewing machine having a clutch arrangement, or to switch means for an electronically controlled sewing machine.

Thus far has been described a traveling buttonhole presser foot which may be used to accomplish what is known as a "one step" buttonhole. In this device, the presser foot 27 is fixed to the presser foot shank 25 and does not move. However, a traveling work engaging shoe 33 is provided which is connected by a coiled flat spring 53 to the presser foot 27 so as to urge the traveling work engaging shoe into a specific position with respect to the presser foot when unrestricted by pressure contact with the work material. However, it frequently occurs that when a work material is positioned beneath the sewing needle 22 and pressure has been applied by the presser bar 24 through the presser foot shank to the presser foot 27, that it becomes apparent that the work material has been mispositioned. In this event it may occur that an operator will seek to reposition the work material by grasping and moving the same to the proper position without elevating the presser bar 24 to relieve the pressure thereon. For the embodiment of the traveling presser foot shown where the operator attempts to move the material towards herself no ill effects will develop. However, if the operator attempts to move the material away from herself to a proper position while the work material is under pressure, she will move the traveling work engaging shoe 33 rearwardly also. The result is that the first leg of the buttonhole will be shorter because the actuating tab 70 has been shifted rearwardly together with the traveling work engaging shoe 33 which carries the button gauging element 60 of which the actuating tab is a part of. The faulty buttonhole thus obtained is shown in FIG. 3 wherein the misplaced bar tack A resulted in a shorter leg B due to striking of the paddle 76 by the actuating tab 70 earlier than desired. After completion of the second bar tack C the last leg of the buttonhole D is completed to the length initially desired until the actuating tab 74 strikes paddle 76. In this case misposition of the work material resulted in a shorter buttonhole with one leg thereof overrunning the initial bar tack. It will be apparent to those skilled in the art that other configurations of the traveling work presser foot may occasionally result in other defects deriving from the same source which may result in elongated buttonholes having one leg that fails to meet the initial bar tack.

The above defects are obviated by the method of this invention wherein an initial stitch or stitches are made in a direction which would tend to place the traveling work engaging shoe 33 in the initiating position. For the embodiment disclosed herein, it is apparent that if the traveling work engaging shoe 33 is urged, as an initial step in buttonholing, in a direction towards an operator, that is in a direction to relax the coiled flat spring 53, that if the work engaging shoe had been mispositioned it would be urged into a more correct position. If, on the other hand, the traveling work engaging shoe 33 had not been mispositioned the feed dog 15 would merely slip on the work material without causing any motion thereof. In order to insure slippage of the feed dog 15, a work engaging plate may be utilized as taught in the U.S. Pat. No. 3,877,403, issued on Apr. 15, 1975, and assigned to the same assignee as the instant invention, which is hereby incorporated by reference herein. In that patent it is taught that the work material may be carried between the work engaging plate, which moves with the work engaging shoe 33, and the work engaging shoe itself. Thus, slippage would take place between the work engaging plate and the feed dog 16.

Figure 1:
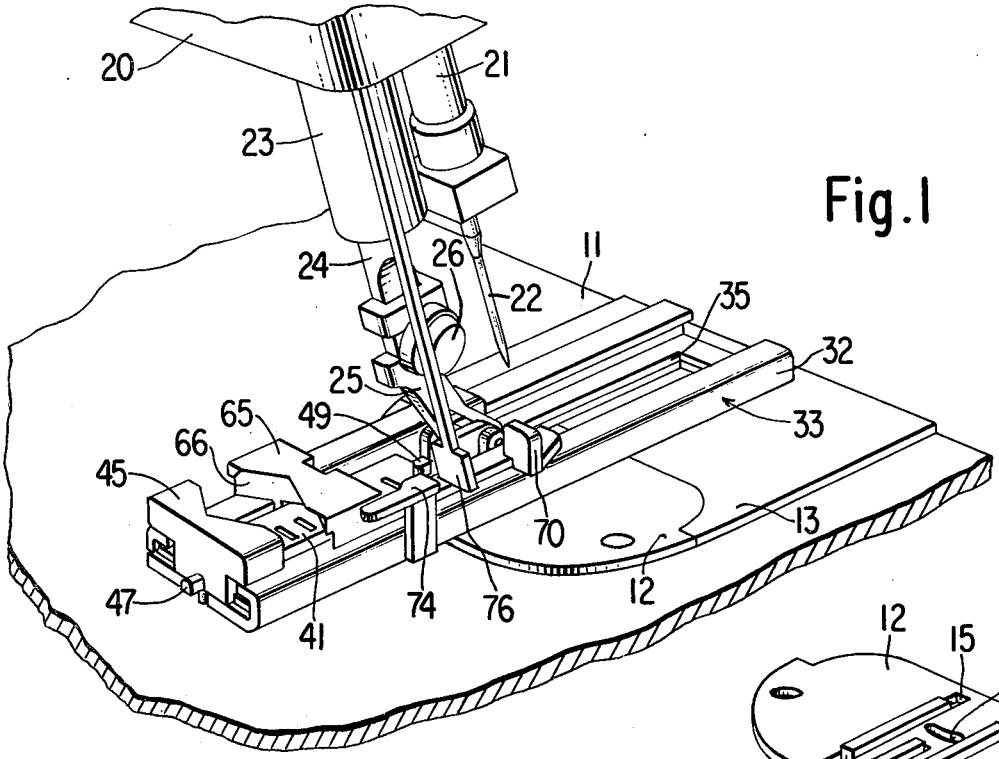
FIG. 1 is a perspective of a portion of a sewing machine having a traveling buttonhole presser foot attached thereto.
Figure 1A:
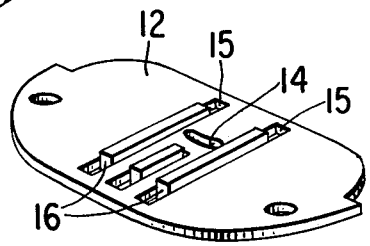
FIG. 1*a* is a perspective view of the throat plate shown in FIG. 1 with feed dogs extending therethrough.

In the embodiment disclosed, it is apparent that the presser foot 27 remains in a fixed position relative to the presser bar 24 and that the coiled flat spring 53 trapped in a shallow cavity 51 in the anchor element 40 tends to draw the anchor element and the presser foot into intimate contact whenever unrestricted frictionally. Since the anchor element 40 is affixed to the traveling work engaging shoe 33, it is easy to see that because of frictional engagement with a work material the anchor element 40 can be separated from the presser foot 27, and that rearward feed by the sewing machine feed dog 15 feeding the work material toward a sewing machine operator will tend to restore the anchor element and presser foot in intimate contact. Thus for the specific embodiment of the buttonholing presser foot disclosed in FIGS. 1 and 2, the first 10 stitches for the buttonhole may be as indicated in the table of FIG. 4. In the table, the first two feed motions are relatively large and in the reverse direction in order to insure that the presser foot 27 and the anchor element 40 are in intimate contact. In the event that the presser foot 27 and anchor element 40 are already in direct contact, no further motion can take place and the feed dog 15 will slip on the work material, or feed stall will take place. During the two large magnitude feed reversing motions the sewing machine may be placed in a skip stitch mode by the use of a device similar to that taught in the U.S. Pat. No. 3,872,809, issued on Mar. 25, 1975 to Adams et al, which is assigned to the same assignee as the instant application, and is hereby incorporated by reference herein. Alternatively, if no such basting mechanism is available the sewing needle 22 of the sewing machine may be placed in a position to the center of either buttonhole leg in order that stitching performed during the reversed feeding may subsequently be hidden or covered by the stitching for the buttonhole leg. After the large magnitude feed reversing motions performed to insure intimate contact between the presser foot 21 and the anchor element 40, stitching of the buttonhole proper may take place as indicated at stitches 3 to 10 which implement the first bar tack of the buttonhole. The table of FIG. 4 does not include the stitch position coordinates beyond stitch 10 for the sake of brevity only.

In FIG. 5 is shown a partial diagram of the buttonhole using the method of this invention. In this diagram it is assumed that a skip stitch device was available, and therefore the starting points 1, 2 and 3 are not joined by lines to indicate that no stitch has taken place. In this diagram, it was also assumed that the work material had been shifted causing the traveling work engaging shoe 33 to move away from an operator a distance equal to the dimension from point indicated as 1, to the point indicated as 3. At point 3, the initial stitch takes place at center needle position with a next feed increment of 0 (see table of FIG. 4). Stitch 4 takes place at full left position (0.120) and at 0 feed increment from stitch number 3. Stitch number 5 takes place at full right needle position and with a 0 feed increment from the stitch 4. In stitch 5 a feed increment of 0.017 inches in the forward direction which was implemented prior to the positioning of the sewing needle 22 on stitch number 6 to the full left position once more. In the diagram the remainder of the table of FIG. 4 was implemented and there is further shown the first leg of the buttonhole partially completed. It is apparent from this diagram that an initial misposition of the traveling work engaging shoe 33 has been compensated for by the method of this invention.

We claim:

1. A method for initiating stitching of a one step buttonhole in a piece of material by a zig zag sewing machine having a zig zag stitching mechanism, a reversible work feeding mechanism, intelligence retaining means for retaining a record of a buttonhole stitch position coordinates for production of a first segment of a buttonhole end and side bar followed by production of a second segment of an opposite end and side bar, and a presser foot having a sliding portion thereof biased to an initiating position and movable with a work material during formation of a buttonhole, said presser foot including means operatively connected to said intelligence retaining means for initiating release of intelligence from said intelligence retaining means for production of said second segment of said buttonhole; the method comprising the step of:

operating said sewing machine for at least one stitch cycle with said reversible feeding mechanisms set to feed in a direction to urge said sliding portion of said presser foot to said initiating position.

2. A method for initiating stitching of a one step buttonhole on a piece of work material by a zig zag sewing machine having an actuating mechanism, a zig zag lock stitching mechanism including a needle bar connected by a latch mechanism to said actuating mechanism, means for disengaging the latch mechanism from the actuating mechanism, a reversible work feeding mechanism, intelligence retaining means for retaining a record of buttonhole stitch position coordinates for production of a first segment of a buttonhole end and side bar followed by production of a second segment of an opposite end and side bar, and a presser foot having a sliding portion thereon biased to an initiating position and movable with a work material during formation of a buttonhole, said presser foot including means operatively connected to said intelligence retaining means for initiating release of intelligence from said intelligence retaining means for production of said second segment of said buttonhole; the method comprising the steps of:

(a) unlatching the needle bar from the actuating mechanism; and, (b) operating said sewing machine for at least one stitch cycle with said reversible work feeding mechanism set to feed in a direction to urge sliding portion of said presser foot to said initiating position while said needle bar is disconnected from said actuating mechanism.

3. A method of initiating the stitching of a buttonhole by a zig zag sewing machine having means for selectively reversible work material feeding, and a presser foot having a sliding portion for traveling with a work material during the formation of a buttonhole, said sliding portion of said presser foot having a means for biasing said sliding portion to an initial position from which actuation of said buttonhole is inititated in opposition to said biasing means, which method comprises the step of actuating said feeding means for at least one stitch in a direction to move said sliding portion of said presser foot to said initial position, whereby inadvertent misposition of said sliding portion may be corrected.

* * * * *